US006591458B1

(12) United States Patent
Henninger

(10) Patent No.: US 6,591,458 B1
(45) Date of Patent: Jul. 15, 2003

(54) TOP COMB

(75) Inventor: Friedrich Henninger, Flachslanden (DE)

(73) Assignee: Staedtler & Uhl, Scwabach (DE)

( * ) Notice: Subject to any disclaimer, the term of this patent is extended or adjusted under 35 U.S.C. 154(b) by 0 days.

(21) Appl. No.: 10/111,303

(22) PCT Filed: Oct. 11, 2000

(86) PCT No.: PCT/EP00/09978

§ 371 (c)(1),
(2), (4) Date: Apr. 23, 2002

(87) PCT Pub. No.: WO01/31098

PCT Pub. Date: May 3, 2001

(30) Foreign Application Priority Data

Oct. 23, 1999 (DE) ..... 199 51 126

(51) Int. Cl.[7] ..... D01G 19/00
(52) U.S. Cl. ..... 19/115 R; 19/235
(58) Field of Search ..... 19/65 A, 65 R, 19/115 R, 150, 157, 215, 225, 233, 235

(56) References Cited

U.S. PATENT DOCUMENTS 2,572,122 A * 10/1951 Dudley et al. ..... 19/223
2,802,241 A * 8/1957 Dudley ..... 19/235
4,970,851 A * 11/1990 Eichenberger et al. ..... 56/34
5,060,346 A * 10/1991 Bischofberger et al. ..... 19/225
5,369,844 A * 12/1994 Locatelli et al. ..... 19/0.2
5,467,506 A * 11/1995 Nishikawa ..... 19/223

FOREIGN PATENT DOCUMENTS

| | | | |
|---|---|---|---|
| CH | 679590 | A5 | 3/1992 |
| CH | 680 928 | A5 | 12/1992 |
| DE | 4 24 830 | | 2/1924 |
| DE | 5 82 584 | | 8/1933 |
| DE | 195 04 134 | C2 | 8/1998 |
| EP | 0 557 698 | A1 | 9/1993 |

* cited by examiner

*Primary Examiner*—Gary L Welch
(74) *Attorney, Agent, or Firm*—Browdy and Neimark, P.L.L.C.

(57) ABSTRACT

The invention relates to a top comb for a textile treating or processing machine, especially a combing machine. Said top comb comprises a plurality of needles that are arranged in at least one row in a side-by-side parallel relation. Said needles, at least in some sections, have a pitch unequal 90° relative to the theoretical plane of movement of the fiber strip to be combed. A nipper unit is mounted before the top comb in the direction f movement and a pair of take-down rollers after the top comb. The aim of the invention is to improve the combing capacity of such a top comb. To this end, the needles of the top comb have a pitch (α) 92°, especially 95° in the area of the free needle point.

9 Claims, 4 Drawing Sheets

TOP COMB

BACKGROUND OF THE INVENTION

The present invention relates to a fixed comb for a textile treatment or processing machine, specifically a combing machine, comprising a plurality of adjacent needles disposed in at least one row, which have, at least in sections, a working angle not equal to 90° relative to the theoretical movement plane of the sliver being combed, wherein, viewed in the direction of the movement, a nipper unit is disposed before the fixed comb and a pair of take-off rollers is disposed after the fixed comb.

A fixed comb of the above type, or a combing machine with a fixed comb of the above type, is known, for example, from CH 679 590 A5. The known fixed comb has a free needle projection wherein the needles in that region are angled such that the angled region at the free end of the needle extends in the direction of the movement, viewed relative to the sliver. Solutions of this type are known also in various other embodiments, for example from EP 0 557 698 A1. Conventionally, the angling or curving of the needles is intended to achieve that the sliver becomes caught in the needles and is guided to their center region.

With this as the starting point, the invention has as its object to improve a fixed comb of the above type in such a way that an improvement of the combing result is attained at least in conjunction with certain types of textile treatment and processing machines.

This object is met according to the invention in such a way that the needles of the fixed comb in the region of the free needle projection have a working angle>92°, particularly >95°. An optimal angle, for example, is 98°. Surprisingly it has been found that the result of such a design of the free needle projection is that the needle trim is always free, and the fibrous web is thus able to easily penetrate into the comb, and boll fragments, burl and noils accordingly are held back. Boll fragments, burls and noils that initially become stuck due to an unfavorable shape or size are pushed down into the comb-out position of the circular comb by the upper nipper element, off the fibers that remain in the comb and protrude out of the comb itself, after the combed staple has been taken off. By this process, which is aided by the inventive needle position, the fixed comb cleans itself during the combing process. In the subsequent combing cycle, the sliver end that was previously combed out by the circular comb can thus easily penetrate into the clean fixed comb. This results in less stress on the entire fixed comb as well as on its fastening components. Due to the lesser stress, which remains virtually constant during the entire operating time of the machine, the combing machine can be precisely adjusted, which results in an optimization of the combing process, i.e., specifically the percentage of long fibers in the combing waste is reduced and the combing process can be adapted to the desires of the individual customer. The inventive design can also be applied very advantageously in combination with a fixed comb that is known per se, which is additionally cleaned pneumatically.

In a further embodiment of the invention, provision may be made for the needles to be curved convexly against the direction of movement of the sliver. Specifically, the curvature of the needles and optionally that of the cover plates may be largely coaxial to the upper take-off roller. This results in the free needle projection extending very closely to the region between the two take-off rollers, which provides for an improvement in the combing result.

The invention will be explained in detail below, based on a preferred embodiment in conjunction with the drawing, in which:

DETAILED DESCRIPTION OF THE INVENTION

Figure 1:
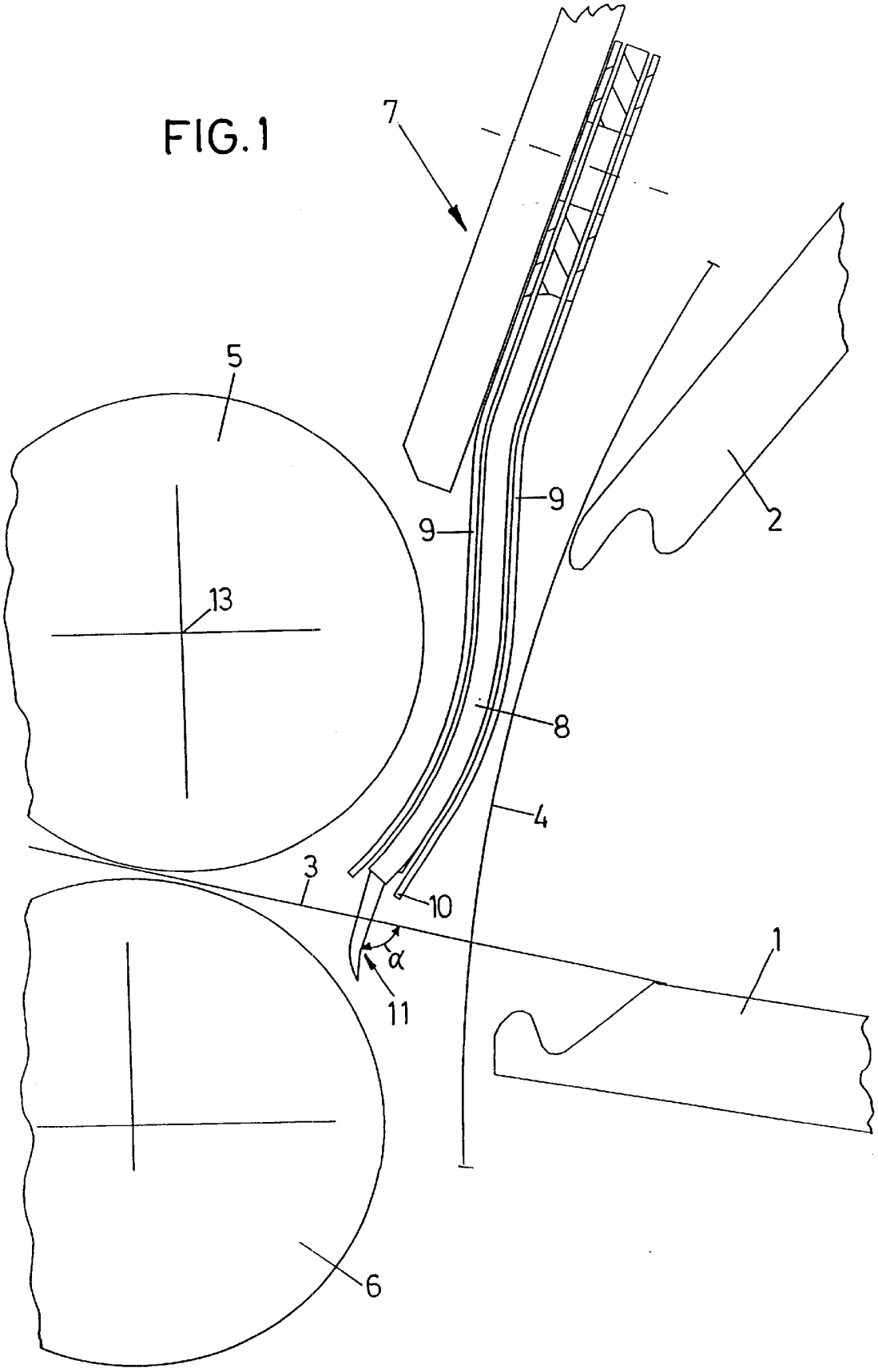
FIG. 1 shows a side view of the combing region of the fixed comb with an opened nipper unit.

A combing machine of the type shown in the drawing comprises a nipper unit composed of a lower nipper element 1 and an upper nipper element 2, wherein the upper nipper element 2 is movably supported on the lower nipper element 1 for gripping the sliver 3 during a combing movement along a circular arc section 4. The removal and further conveyance of the sliver after completion of the combing movement takes place by means of the two take-off rollers 5 (upper take-off roller) and 6 (lower take-off roller).

The fixed comb 7 comprises a row of adjacent needles 8, which may be, e.g., stamped elements and are held on cover plates 9.

Below the lower edge 10 of the cover plates 9 the free needle projection 11 extends into the sliver 3 in order to comb the same during a relative movement between the needles 8 and the sliver 3.

Figure 2:
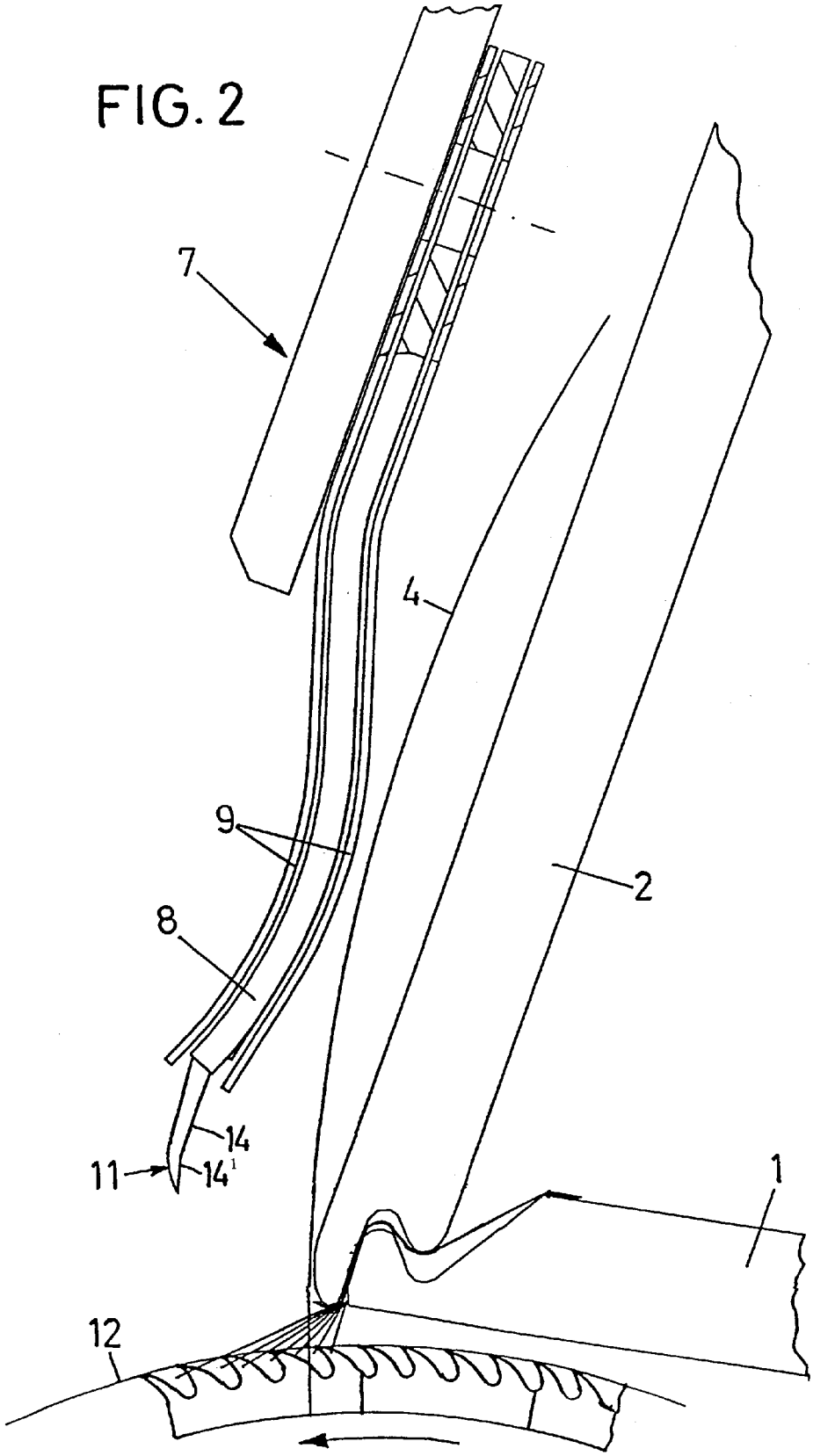
FIG. 2 shows an illustration according to FIG. 1 with a closed nipper unit.

While the respective upper and lower nipper element 2 or 1 is shown in an open position in FIG. 1, FIG. 2 shows the closed position in which the sliver 3 is held between the nippers, and the freely projecting region of the sliver 3 is combed by means of the circular comb 12, which is shown only schematically.

The needles 8 and the cover plates 9 of the fixed comb 7 have a curvature that extends approximately coaxial to the center point 13 of the upper takeoff roller 5 so that the free needle projection 11, as apparent in FIG. 1, extends particularly close to the contact region between the take-off rollers 5, 6, which has proven very advantageous for the combing result.

Figure 3:
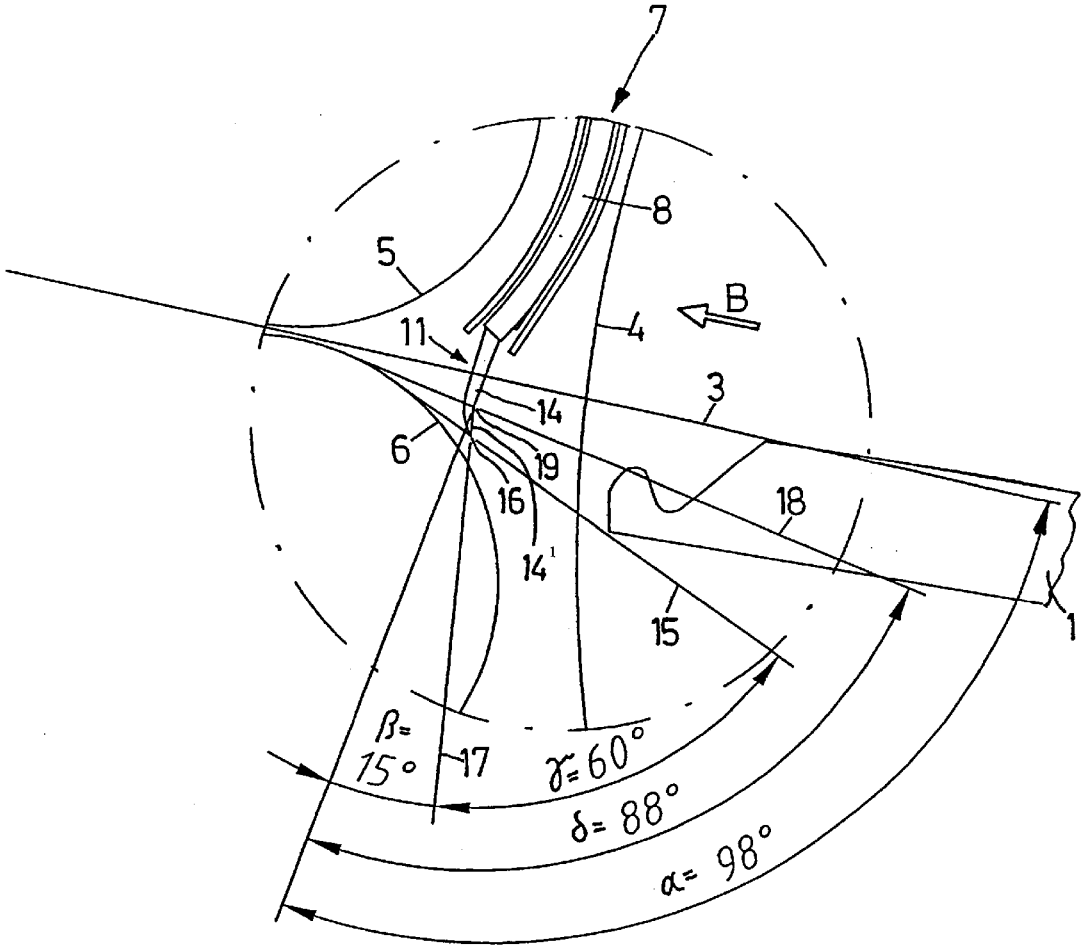
FIG. 3 shows an enlarged illustration of the combing region to illustrate the geometric relationship.

In FIG. 3 the relationships in the area of operation of the free needle projection 11 of the fixed comb 7 are shown again in more detail. From this it is apparent that the working angle a between the front edge 14 of the needles 8 viewed in the direction of the movement (arrow B) of the sliver 3 and the theoretical center plane of the sliver 3 which sliver 3 lies is 98°, i.e., in accordance with the invention it is considerably greater than 90°.

The needle projection 11 is angled in the region of its free front end 14' by an angle $\beta$ of 15° relative to the front edge 14 so that for the tangent 15 starting from the tip 16 of the needles 8 to the lower take-off roller 6, an angle $\gamma$ of 60° results relative to the extension 17 of the rear free front edge 14' of the angled region of the needles 8, or an angle of altogether 75° to the rear front edge 14 of the needle 8. The angle $\delta$ of the tangent 18 through the crown 19 of the angled bend to the lower take-off roller 6 relative to the front edge 14 is 88°.

The above-described geometric relationships result in particularly favorable combing results.

Figure 4:
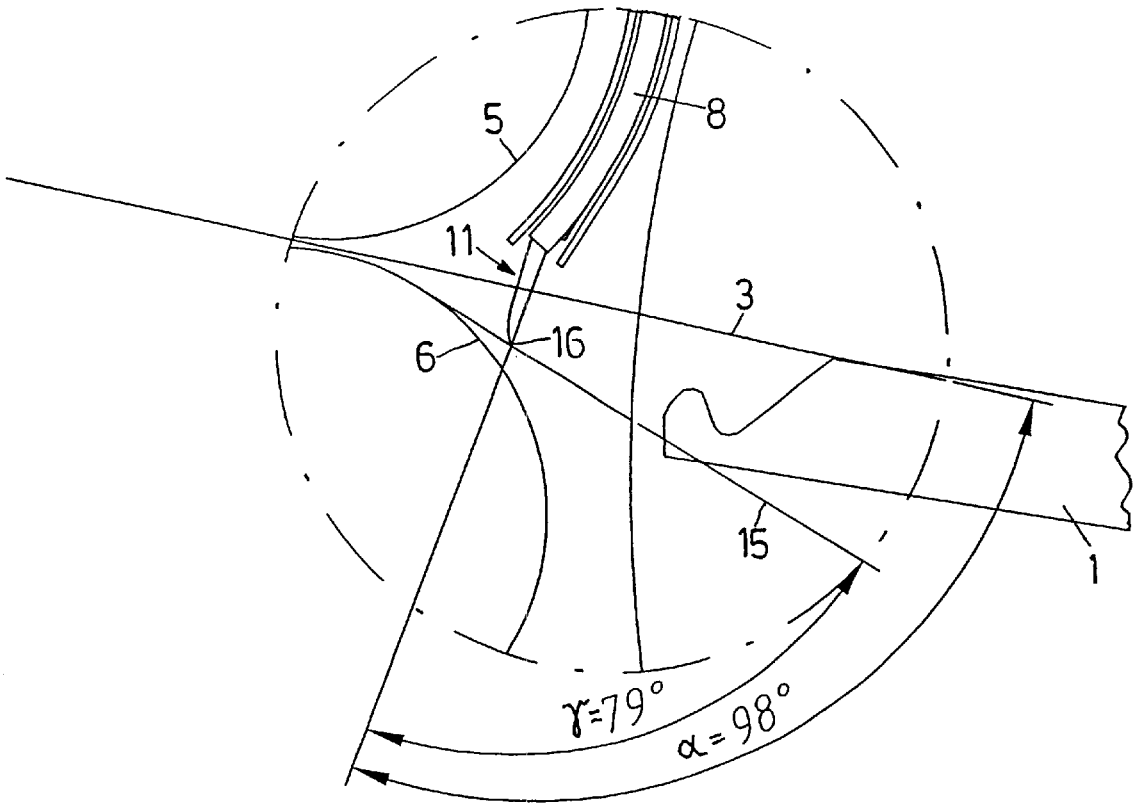
FIG. 4 shows an illustration corresponding to FIG. 3 of a modified embodiment.

In FIG. 4 a similar illustration has been implemented as in FIG. 3, however, the projection 11 of the needles 8 does not have an angled bend. The angle α is also 98°. The angle y of the tangent line 15 through the tip 16 to the lower take-off roller 6 is 79°.

What is claimed is:

1. A fixed comb for a textile treatment or processing machine, comprising a plurality of adjacent needles disposed in at least one row, which have, at least in sections, a working angle not equal to 90° relative to the a theoretical movement plane of the a sliver being combed, wherein, viewed in the a direction of the movement B of the sliver, a nipper unit is disposed before the fixed comb and a pair of take-off rollers is disposed after the fixed comb, characterized in that wherein the sliver (3) extends without deflection between a lower nipper element (1) of said nipper unit and the take-off rollers (5,6), and the needles (8) of the fixed comb (7) have a working angle α>92° in the a region of free needle projection (11)), wherein the working angle α of the free needle projection (11), measured between the movement plane (3) viewed in the direction of the movement B of the sliver before the fixed comb (7) and an extension of a front needle edge (14) approximately 98°.

2. A The fixed comb according to claim 1, characterized in thatwherein the needles (8) in the region of the free needle projection (11) are curved convexly against the direction of movement (arrow B) B of the sliver.

3. A The fixed comb according to claim 2, characterized thatwherein the curvature of the needles (8) extends approximately coaxial to the axis of rotation (13) of the upper take-off roller (5).

4. The fixed comb of claim 1 wherein the needles (8) of he fixed comb (7) have a working angle α>95°.

5. A fixed comb for a textile treatment or processing machine, comprising a plurality of adjacent needles disposed in at least one row, which have, at least in sections, a working angle not equal to 90° relative to a theoretical movement plane of a sliver being combed, wherein, viewed in a direction of movement B of the sliver, a nipper unit is disposed before the fixed comb and a pair of take-off rollers is disposed after the fixed comb, wherein the sliver (3) extends without deflection between a lower nipper element (1) of said nipper unit and the take-off rollers (5,6), the needles (8) of the fixed comb (7) have a working angle α>92° in a region of free needle projection (11), wherein an angle between the front needle edge (14) of the free projection (11) of the needles (8) and a tangential line (15) through a needle tip (16) to the lower take-off roller (6) is 65° to 85°.

6. The fixed comb according to claim 5, wherein the needles (8) are curved convexly against the direction of movement (arrow B) of the sliver.

7. The fixed comb according to claim 6, wherein the curvature of the needles (8) extends approximately coaxial to the axis of rotation (13) of the upper take-off roller (5).

8. The fixed comb of claim 5 wherein the needles (8) of he fixed comb (7) have a working angle α>95°.

9. The fixed comb according to claim 5, wherein said angle between the front edge (14) and the tangential line (15) is 75° to 80°.

* * * * *